US005406680A

United States Patent [19]

Silverberg

[11] Patent Number: 5,406,680

[45] Date of Patent: Apr. 18, 1995

[54] FIRMLY GRIPPING HIGH CAPACITY PAPER CLIP

[76] Inventor: Morton Silverberg, 24 Edgewater Commons, Westport, Conn. 06880

[21] Appl. No.: 98,518

[22] Filed: Jul. 28, 1993

[51] Int. Cl.[6] ..... B42F 1/00

[52] U.S. Cl. ..... 24/67.9; 24/67 R; 24/546; 24/547; 24/555

[58] Field of Search ..... 24/67.9, 67 R, 67.3, 24/545, 546, 547, 548, 551, 555, 553, 556, 483, 563

[56] References Cited

U.S. PATENT DOCUMENTS

| | | | |
|---|---|---|---|
| 743,017 | 11/1903 | McGill | 24/545 |
| 969,700 | 9/1910 | Hylkema | 24/553 |
| 1,133,664 | 3/1915 | Plummer | 24/555 |
| 1,167,734 | 1/1916 | Anderson | 24/547 |
| 1,336,626 | 4/1920 | Hall | 24/547 |
| 1,344,473 | 6/1920 | Baldwin . | |
| 2,642,638 | 6/1953 | Larrabee | 24/67.9 |
| 2,781,566 | 2/1957 | Hammer | 24/66 |
| 3,083,425 | 4/1963 | Minnerly, Jr. | 24/66 |
| 4,658,479 | 4/1987 | Sanders | 24/546 |
| 4,949,435 | 8/1990 | Michelson | 24/67.9 |

FOREIGN PATENT DOCUMENTS

| | | | |
|---|---|---|---|
| 317844 | 11/1902 | France | 24/67.9 |
| 1212938 | 3/1966 | Germany | 24/67 R |

OTHER PUBLICATIONS

Henry Petroski; The Evolution of Useful Things; American; Sep.-Oct. 1992.

Scientist vol. 80; Sep.-Oct. 1992; pp. 418-419.

Noesting Catalog pp. 4 & 6, no date is given.

*Primary Examiner*—Victor N. Sakran

[57] ABSTRACT

A family of improved paper clips and a process for their formation is disclosed which comprises a central bridge leg joining two overlapping and contacting gripping jaws. Each gripping jaw lies in its own plane and controlled torsional forces in the legs comprising the jaws provide for independently controlled gripping forces at multiple tangential contact points. The controlled gripping forces and two layer planar shape result from a substantially elastic transformation from a preceding stepped helix wire form. The advantages include a firm grip on thin or thick packets, the ability to stay flat on thick packets of material, resistance to distortion, special features to aide application to thin or thick packets of material, and modest size facilitating its general purpose use.

10 Claims, 5 Drawing Sheets

FIRMLY GRIPPING HIGH CAPACITY PAPER CLIP

BACKGROUND

1. Field of Invention

This invention relates to paper clips which are removable, and preferably reusable, means of holding together collections of papers or other materials as well as serving as place markers in a book and/or locations on a page.

2. Prior Art

The most common paper clip, known as a Gem style configuration, originated about 1900. Its deficiencies include not lying flat when used with even modestly thick packets, unsuitability for use with thick packets, somewhat difficult to apply, weak gripping force with thin packets, tendency to dimple materials when left in place for any significant time, easily distorted, cut ends that can dig into and damage the surface sheets, etc.

These deficiencies, particularly ease of application and suitability for thick documents, have been addressed by other paper clip patents and product designs over the years. None however have offered sufficiently significant advantages to displace the Gem style as the dominant general purpose product design and only a relative few survive as niche products.

Comments on the products and patents most relevant to the instant invention follow:

Universal, Imperial and Ezeon style paper clips appear to derive from U.S. Pat. No. 1,344,473 Baldwin (1920). They consist of a relatively short, straight, central bridge leg connected to two near parallel and perpendicular side legs. Ending legs attached at the bottom of the side legs angle off at less than 45 degrees to the side legs and make one or more tangential contacts with the opposing side leg. Their central funnel mouth makes them easy to attach but as a group they have only a modest grip, easily distort and do not lie flat when used with thicker documents.

Ideal style paper clips are generally built in larger sizes and involve a relatively long, straight, central bridge leg connected to two crossing, diagonally angled side legs. The lower ends of these diagonal legs are coupled to two ending legs which Consist of a short vertical segment and a longer angled segment which crosses, but does not contact, its opposite member. Its forte is easy application to, and relatively good ability to lie flat with, thick packets. It also eliminates the risk of paper dimpling over time. However it is not suitable for general purpose use with only a few sheets due to its large size, limited gripping strength, and tendency to grip and pivot about only a single one of its crossing leg paths. Additionally the lower angled corners of the clip protrude substantially beyond the boundary of the opposing gripping jaw due to the crossing point of the the two side legs being approximately at the midpoint of the side legs. These protruding corners easily lift out of contact and can snag other pages.

U.S. Pat. No. 4,949,435 by Michelson (1990) has an objective of providing a paper clip that can stay flat when used with large packets of materials. However it has only limited gripping force for both thin and thick packets, its single pinch point and limited gripping footprint allows the clip to be easily dislodged, the clip and/or material being gripped pivots too easily, the ability to stay flat is limited and it has a similar excessive projection limitation as with the Ideal style.

U.S. Pat. No. 3,083,425 by Minnerly (1963) describes a clip geometry that is intended for gripping thick packets and provides for means to achieve a preloaded gripping action. However the design does not provide for sufficient elasticity between its gripping jaws, would not lie flat in its ready to use state and proposes a difficult to accomplish and control final folding action.

OBJECTS AND ADVANTAGES

The object of the present invention is to provide for a family of general purpose paper clips with the following combination of features:

- Suitable for general purpose use on thin to thick packets of materials.
- A firm, controlling, and not easily dislodged grip on thin packets of materials.
- A stronger, controlling, and not easily dislodged grip on thick packets of material.
- Ability to lie flat when used with thick packets of: material.
- Easy and gentle insertion onto thin, relatively fragile materials.
- Easy insertion onto thick packets of materials.
- Improved reusability and resistance to distortion.
- Elimination of the risk of the free ends of the clip digging into the packet surfaces and causing damage.
- Elimination of the risk of causing long term material dimpling of the material being gripped.
- Low fabrication cost.
- Suitable for attaching advertising massages to facilitate use as a promotional item.

Further objects and advantages of my invention will become apparent from a consideration of the drawings and ensuing description.

DESCRIPTION OF DRAWINGS

FIGS. 1*a* through 3*b* are various views of a seven leg embodiment of the invention.

FIG. 1*a* is an isometric view.

FIG. 3*b* is a top view of this clip configuration used with a relatively thick packet of material.

FIG. 4*a* is a front view of the required stepped helical shape of the five leg configuration prior to its transformation.

FIG. 4*b* is an intermediate step in the transformation of the five legged embodiment.

FIG. 4*c* is a front view of a five legged configuration ready for use.

DESCRIPTION OF INVENTION

Two embodiments of the invention will be described. Both use a single, short length, of wire formed into legs by intermediate bends which total about 540 degrees. One embodiment uses seven legs and the other five legs.

Figure 1B:
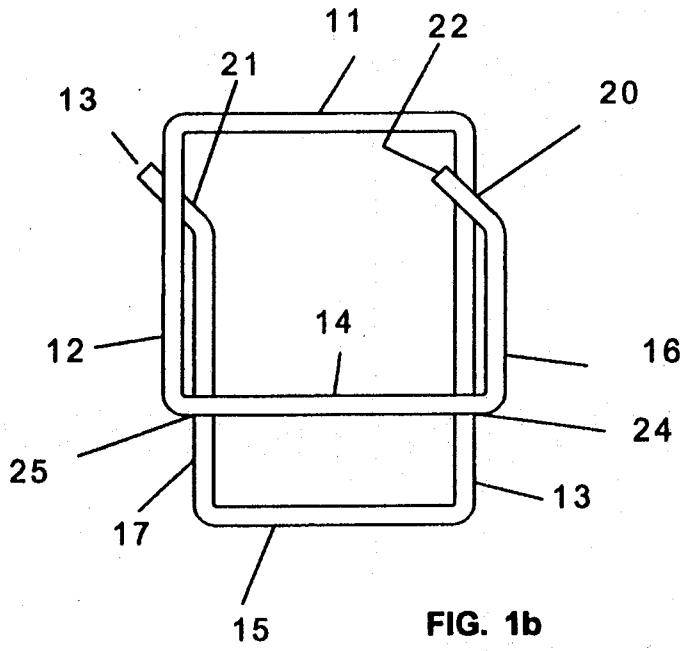
FIG. 1*b* is a frontal view.
Figure 1A:
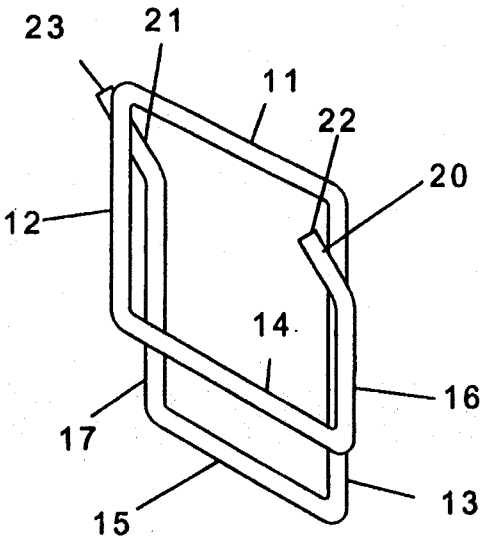
Figure 1D:
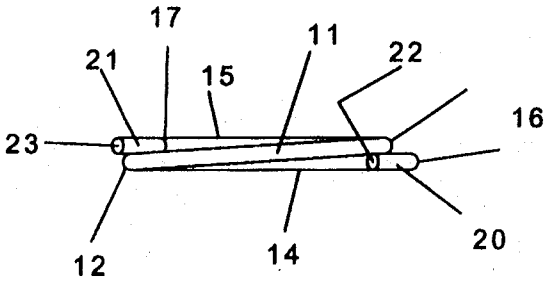
FIG. 1*d* is a top view.

An isometric view of the seven leg embodiment is shown in FIG. 1*a* and a front view in FIG. 1*b*. It consists of two roughly U shaped, overlapping and multi-gripping jaws joined by a central bridge leg 11. One gripping jaw is wider and shorter than the other. A wider gripping jaw is composed of a short side leg 12, an upper transverse leg 14, and a short ending leg 16 which includes bent tip 20. A narrow gripping jaw is composed of a long side leg 13, a lower transverse leg 15, and a long ending leg 17 which includes bent tip 21. A cut end 13 and a cut end 22 terminate ending legs 17 and 16 respectively and preferably do not protrude substantially beyond bent tips 20 and 21 intersection with side legs 12 and 13. Upper transverse leg 14 contacts and extends beyond long side leg 13 and long ending leg 17. This forms a funnel mouth 25 and a funnel mouth 24, either of which can be used to initiate entry of material into the grip of the clip.

Torsional and bending strains in the various legs generate controlled gripping forces at the four tangential contact points where the legs cross. The gripping forces at the two contact points on upper transverse leg 14 are preferably substantially equal to one another as are the gripping forces at the contact points with bent tips 20 and 21.

Figure 2B:
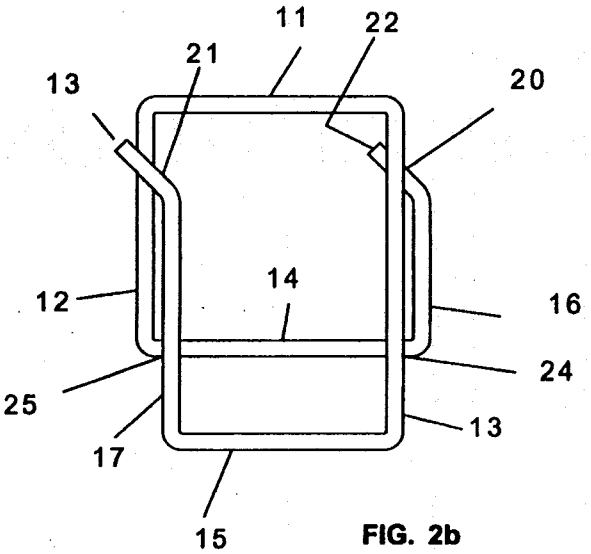
FIG. 2*b* is a front view of the stepped helical wire form before transformation.
Figure 1C:
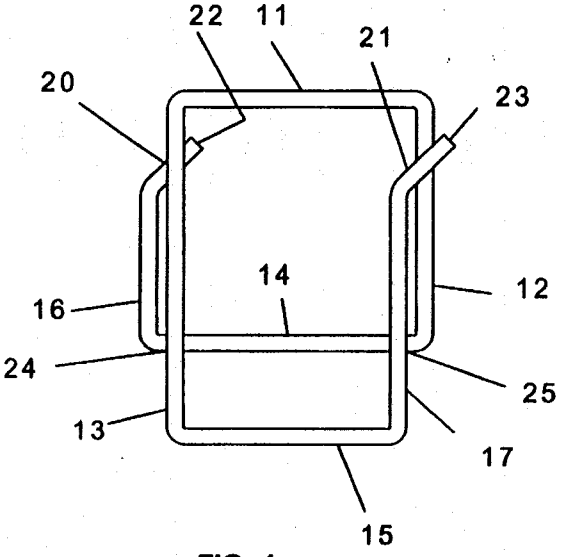
FIG. 1*c* is a rear view.
Figure 2A:
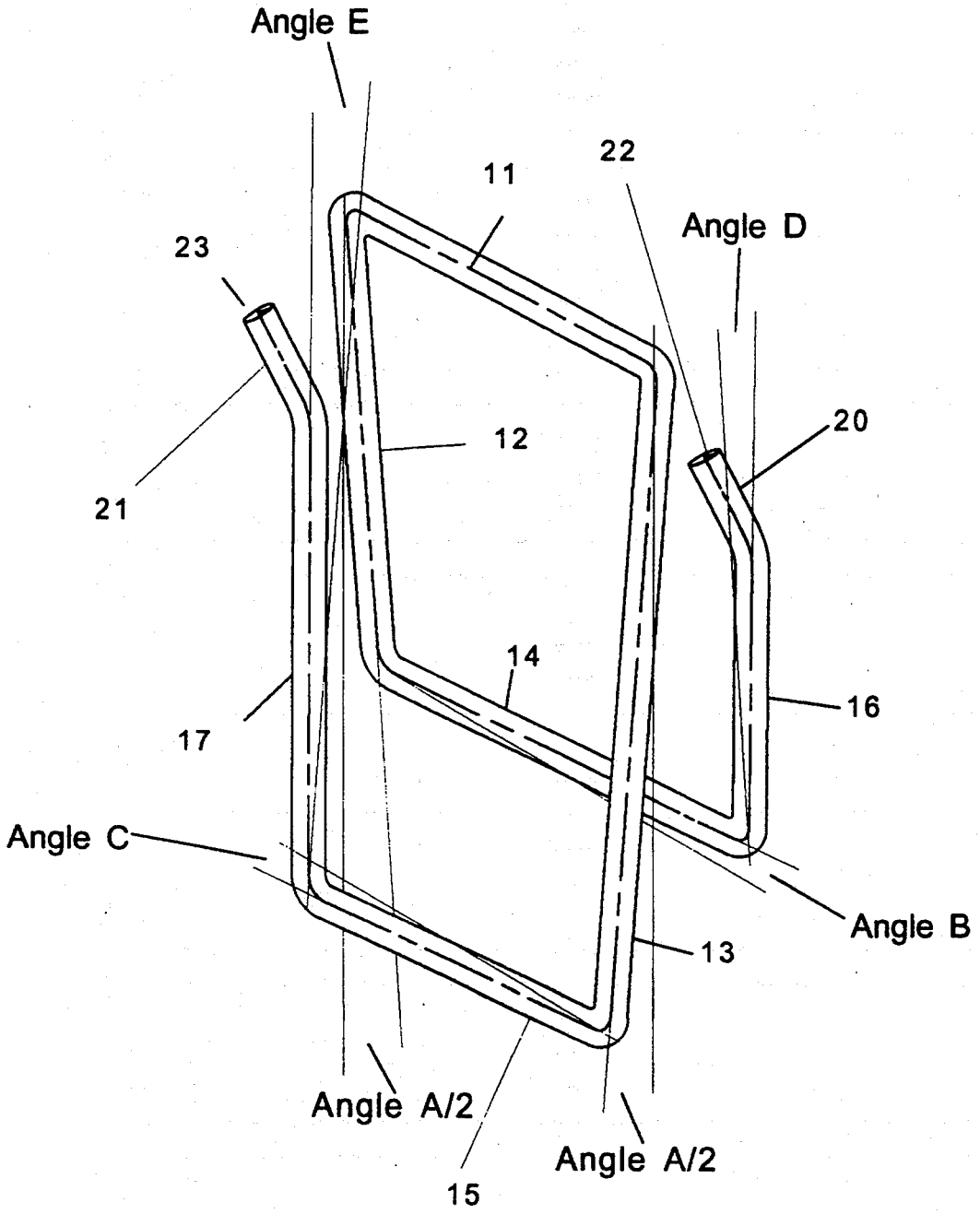
FIG. 2*a* is an isometric view of the required stepped helical wire form after bending and before transformation into a form ready for use as a paper clip.

FIG. 2*a* shows an isometric of the as formed shape required as the initial step to achieve the preferred configuration and gripping forces. The 3-D shape approximates a stepped helix. FIG. 2*b* shows a front view of the stepped helix. The crossing legs in this X–Y plane view do not contact one another due to the wire forms extension into the Z axis.

Side legs 12 and 13 are shown to be at an angle of A with respect to one another about the axis of central bridge 11. This is shown by the two A/2 angles with respect to vertical reference lines. Upper transverse leg 14 makes an angle of B about the axis of short side leg 12 with respect to central bridge 11. Lower transverse leg 14 makes an angle of C about the axis of long side leg 13 with respect to central bridge 11. Short ending leg 16 makes an angle of D about the axis of upper transverse leg 15 with respect to short side leg 12. Long ending leg 17 makes an angle E about the axis of lower transverse leg 15 with respect to long side leg 13.

To the first approximation, the gripping strength of the clip is a function of angles B and C, shown in FIG. 2. Angle C tends to be larger than angle B to compensate for the greater torsional flexibility of long side leg 13 vs short side leg 12. Angle A is chosen to provide a compensating torsional force about the axis of central bridge 11 so that the side legs 12 and 13 lie approximately in the same plane in the transformed state. Angles D and E provide for transferring a portion of the gripping forces between side leg 13 and ending leg 17 with upper transverse leg 14 to the tangential contact points between bent tips 20 and 21 and side legs 13 and 12 respectively. This force transfer provides for easing the start of material into the grip of the clip while maintaining a high total grip force. It also reduces the torsional force on central bridge 11 to lower the rate at which ending legs 12 and 13 become non-parallel when used with thick packets.

The stepped helix wire shape shown in FIGS. 2*a* and 2*b* is transformed into the flattened shape shown in FIGS. 1*a* through 1*d* by the process of flexing and pushing on the side and ending legs so that ending legs 16 and 17 are moved to the side of, past, and then trapped behind side legs 12 and 13. This is most readily accomplished one side at a time. It is also desired that the required wire deformation be within the permanent deformation limits of the wire during the transformation. This is a function of the amount of deflection required by how far the upper transverse leg extends beyond ending leg 17 and side leg 13, the flexibility due to the lengths of the various legs, the wire diameter and the wire yield strength. One advantage of the seven legged embodiment is that the required transformation deformations can be readily accomplished with conventional low yield strength paper clip type wire due to the combination of small required deformations and sufficient total wire length.

The controlled preloaded multiple grip point action is a major advance over other paper clips. It provides for a firm, assured, grip on even a single, thin, page. Other clips only generate gripping forces as they are spread by the packet or have only very limited torsional strain to drive their gripping action. Additionally the multiple gripping points in the improved paper clip are independently preloaded and spaced from one another so to enable the clip and the pages being gripped to resist rotation. The multiple gripping points also allow for an increasingly stronger grip as the packet encounters additional gripping points. This and the ability to use transverse leg 14 as a finger actuated bar to open the clip enable the use of the clip with weak or fragile materials.

The stepped helix wire shape also provides clearance for the wire bending process to achieve the acute bending angles required with high yield strength wire to yield the desired corner angles when the bending force is relaxed. The use of high yield strength wire provides for the clip to resist permanent distortion in use, even with relatively thick packets, and to achieve high gripping forces. The length of central bridge 11 and side legs 12 and 13 also contribute to the clips ability to be used on thick packets without permanent distortion.

Figure 3A:
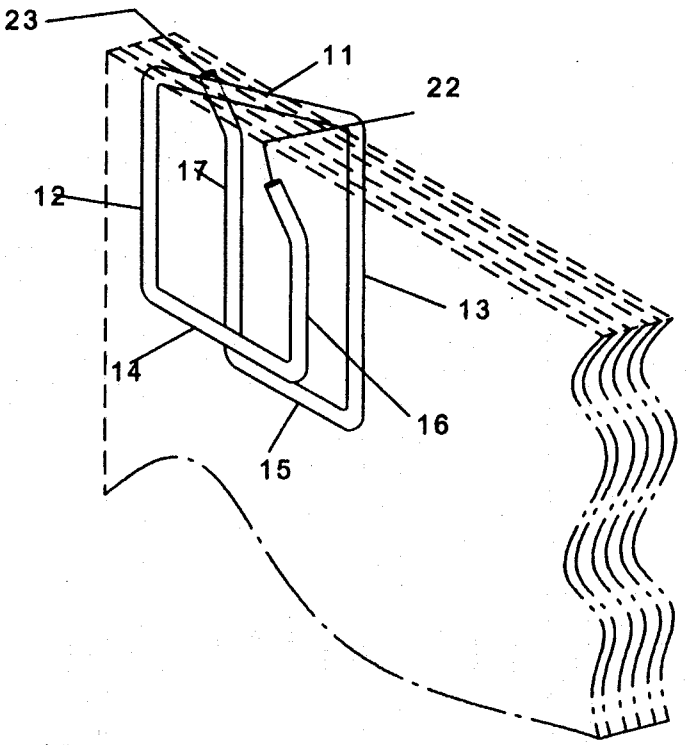
FIG. 3*a* is an isometric view of the clip used with a relatively thick packet of material.
Figure 3B:
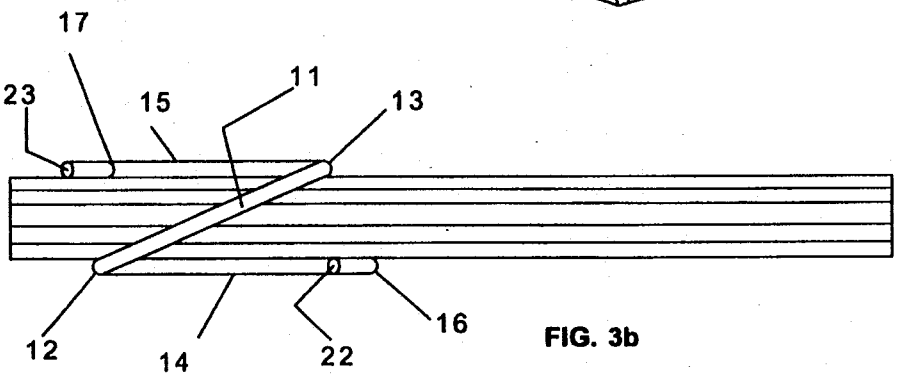

As shown in FIG. 3*a*, an isometric view ;of the clip applied to a thick packet, the clip opens by forming gaps between short ending leg 16 and long side leg 13 as well as between long ending leg 17 and short side leg 12. FIG. 3*b* shows a top view of the application of the clip to a thick packet. Note that the gaps are created by torsional rotation about side legs 12 and 13, with central bridge 11 serving to connect the U shaped sets of legs on each side of the packet. The torsional opening action is facilitated by the length of side legs 12 and 13 and transverse legs 14 and 15. Ending legs 16 and 17 serve to reduce torsional rotation about central bridge; 11. Rotation about this axis is a consequence of the forces on the other legs and limits the maximum practical packet thickness for a clip of a given size. Lifting forces on the lower ends of side legs 12 and 13 tends to raise them off the surfaces of the packet being gripped.

This tendency can be controlled by arranging for side legs 12 and 13 as well as ending legs 16 and 17 to assume a keystone like shape in which their internal angles with respect to central bridge leg 11 are less than 90 degrees and their internal angles with respect to transverse legs 14 and 15 are correspondingly greater than 90 degrees. The keystone geometry biases the lower tips of side legs 13 and 13 against the top and bottom surfaces of thick packets as a consequence of the angle central bridge 11 assumes with respect to the plane of a thick packet.

The gripping actions are between crossing legs and thus does not introduce bending stresses on the material being gripped and thus eliminates the risk of long term material dimpling.

The support and positioning of bent tips 20 and 21 prevents end points 22 and 23 digging into the surfaces of materials being gripped.

Figure 4C:
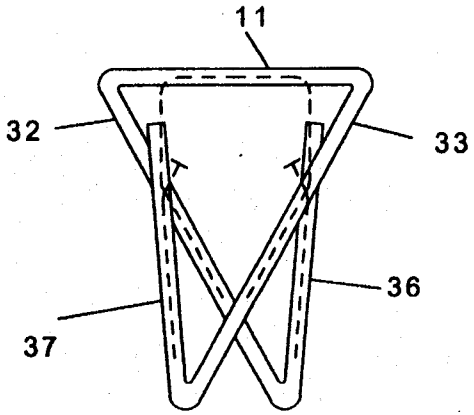
FIGS. 4*a*, 4*b*, and 4*c* are front views of a five legged embodiment.
Figure 4B:
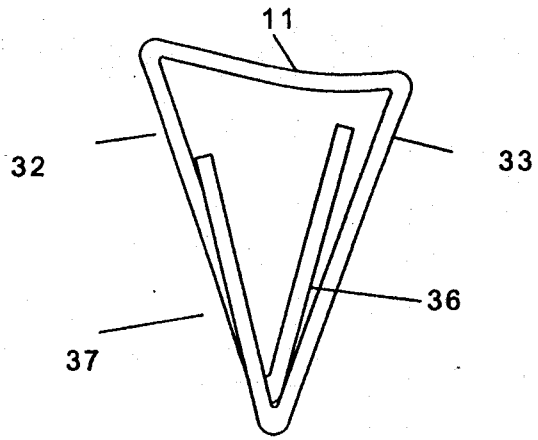
Figure 4A:
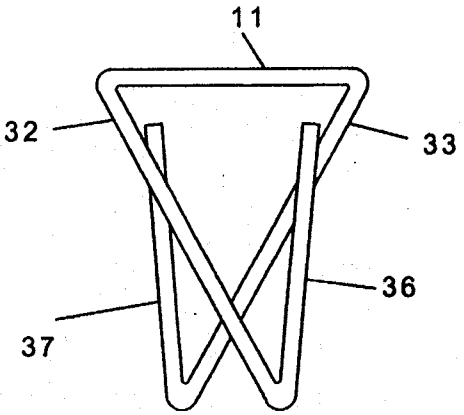

FIG. 4c shows a front view of a five legged embodiment and FIG. 4a is a front view of the required preceding stepped helix shape. As seen in FIG. 4c, the five legged embodiment consists of two V shaped, overlapping, multi-gripping jaws joined by central bridge leg 11. One V shaped jaw consists of side leg 33 and ending leg 37 and the other V shaped jaw consists of side leg 32 and ending leg 36. The side and ending legs may or may not include bent portions in the regions where they make contact as indicated by the dotted central lines in FIG. 4c. Side legs 32 and 33 angle toward one another and make tangential contact before terminating. Ending legs 36 and 37 extend in the direction toward central bridge leg 11 until they terminate shortly after tangentially contacting the side leg on the opposing gripping jaw. These tangential contact points are preferably sufficiently below the line of central bridge 11 so to be assured of gripping the packet. Torsional forces in side legs 32 and 33 determine the gripping forces at the tangential contacts near the tips of ending legs 36 and 37. The gripping strength at the tangential contact of side legs 32 and 33 is a function of the torsional force due to central bridge leg 11 minus the force components due the pinch forces generated by the torsional forces in side legs 32 and 33.

The limiting action in the transformation step from the stepped helix state in the five legged embodiment is the need to bring the two lower points of two V shaped jaws together so that one point can pass inside the other. This intermediate condition is illustrated in a front view in FIG. 4b. Note that side leg 37 has been previously deflected from its stepped helix position under side leg 32 to now rest on it. The magnitude of the required deflection and the limited length of the flexing legs tends to result in at least some permanent distortion, as viewed from the X/Y plane, with desirable combinations of wire diameter and distance between the twin tips. Excessive distortion allows the trapped torsional forces to relax and reduce or eliminate the gripping forces. However a limited amount of distortion can be tolerated during the transformation process and the angles in the X/Y plane reformed after the torsional forces have been trapped. For example a stepped helix for a five legged embodiment can be formed with low yield strength wire with relatively large A angles about the central bridge 11 axis. During the transformation process the wire yield strength essentially determines the gripping force.

As in the seven legged embodiment, the result is multiple, independently controllable, gripping points whose forces are determined by a preceding stepped helix wire form geometry. The short length of its torsional spring element, central bridge leg 11, and smaller lever arms than the seven legged embodiment, causes the gripping force to increase more rapidly with packet thickness than an equivalent sized seven legged embodiment. Low yield strength wire can be used to limit the maximum force at the expense of permanent distortion with thick packets.

The five legged embodiment is very intuitive to apply and exhibits excellent ability to lie flat. It avoids lifting of the lower V bends out of contact with the packet surfaces better than the Ideal style clip because of its combination of longer lever arms provided by the ending leg geometry, the preloaded gripping force at the tangential contacts of side legs 12 and 13, and its more limited projection of the bottom corners beyond the bounds of the opposing gripping jaw.

PREFERRED DIMENSIONS

Preferred dimensions for a seven leg embodiment optimized for general purpose use with packets from a single page up to greater than 8 mm thick are as follows:

- The minimum gap between long side leg 13 and long ending leg 17 for finger access to upper transverse leg 14 must be on the order of 13 mm with 17 mm preferred.
- The minimum length of short side leg 12 is on the order of 13 mm with 19 mm preferred for sufficient depth of grip.
- Long side leg 13 larger than short side leg 12 by a minimum on the order of 6 mm with 8 mm preferred to provide sufficient finger space.
- Upper transverse leg 14 larger than lower transverse leg 15 by preferably no more than 5 mm with 4 mm preferred for appearance considerations and to minimize transformation distortions.
- Pinch points between the tips of the ending legs 16 and 17 and the adjacent side legs 12 and 13 about 6 mm below the line of central bridge 11.
- Wire diameter on the order of 1.27 mm in combination with the other dimensions, scaled upwards in combination with increases in the other dimensions to increase the capacity and/or gripping force.

For general purpose use preferred dimensions for the five legged embodiment are approximately as follows:

- 15 mm between the twin lower tips.
- 15 to 17 mm below central bridge 11 to the tangential contact point between the two side legs.
- 8 mm from the tangential contact of the side legs to a line joining the twin tips.
- 8 mm below central bridge 11 to the tangential contacts of the ending legs 36 and 37 with the side legs 32 and 33.
- Wire diameter on the order of 1.27 mm

USE OF THE INVENTION

In the seven legged implementation funnel corners 24 and 25 provide for guiding modestly thick packets into the grip of the clip with a sliding and twisting action. Either funnel corner 24 or 25 can be used depending on the handedness and preference of the user. Similarly either gripping jaw consisting of legs 13,15, and 17 or 12,14, and 16 can be on top or bottom of the packet.

Application of the seven legged implementation to thick packets can be accomplished in many ways. One preferred approach is best understood with the use of FIG. 1c, a rear view of the preferred configuration. A right handed user rests the corner at the intersection of lower transverse leg 15 with long side leg 13 on top of the stack while holding the clip with the diagonal of the clip approximately perpendicular to the edge of the packet. A thumb is used to push down on upper transverse leg 14. This requires sufficient space for the thumb to protrude between long side leg 13 and long ending leg 17 as well as clearance between upper transverse leg 14 and lower transverse leg 15. The thumb is used to depress the left hand corner of upper transverse leg 14 below the bottom surface of the packet to open the mouth of the clip. The clip is now slid onto the packet and rotated to its final position with central bridge 11 placed close to a packet edge.

The same mouth opening procedure can be used to open the seven legged implementation for use on very fragile material that might be damaged in the process of pushing a lead edge into the grip of the clip.

The five legged implementation uses its central funnel mouth in a twisting action for use with thin or thick packets.

SUMMARY, RAMIFICATIONS AND SCOPE

Accordingly it can be seen that the improved paper clip of this invention provides for a solution that has many advantages over alternate paper clips. These advantages derive from and include:

- A process for the formation of paper clips in combination with a class of geometries which provides for the control and utilization of torsional strains in the appropriate legs of the clip to achieve multiple spaced, independent preloaded pinch points.
- A seven legged embodiment that provides for much greater torsional elasticity in the for opening over thick packets without distortion or excessive gripping force than alternatives.
- Geometry and preloaded force combinations that provide for the clip to stay flat when used with thick packets.
- Use of crossing leg gripping points to eliminate any distorting stresses on gripped material or risk of cut ends of the wire digging into the surfaces being gripped.
- Provision for fabricating the embodiments out of high yield strength wire materials which provide for improved reusability and gripping strength.
- Easy and gentle insertion onto thin and normal sized packet thicknesses.
- Easy insertion onto thick packets of materials.
- Width, shape, and reusability suitable for attaching advertising massage bearing elements for use as a promotional item.

Although the preceding description contains many specificities, these should not be construed as limiting the scope of the invention, but as merely providing illustrations of some of the embodiments of this invention.

Thus the scope of the invention should be determined by the appended claims and their legal equivalents, rather than by the examples given.

What is claimed is:

1. An improved paper clip formed from a single length of wire divided into seven legs by six bends and comprising:

a) a straight central bridge leg connecting overlapping first and second U shaped overlapping gripping jaws, each said gripping jaw comprising a downwardly directed side leg, a horizontal transverse leg, and an upwardly directed ending leg, said gripping jaws lying substantially in contacting planes, and b) said first gripping jaw is wider and shorter than second said gripping jaw, and c) said ending legs terminate shortly before reaching the line of said central bridge leg and after making tangential contact with, said side legs of other said gripping jaw, and d) said transverse leg on said first gripping jaw makes tangential contact with said side leg and ending leg on said second gripping jaw with straight sections of said transverse leg extending at least a millimeter on either side of said side and ending legs, and e) the distance between said side and ending legs of said second gripping jaw is sufficiently large for a finger to reach through to contact said transverse leg on said first gripping jaw, f) elevated and controlled levels of torsional strain in multiple legs serve as torsion springs to exert distributed and controlled minimum gripping forces at multiple said tangential contact points; wherein said first ending leg makes a bend after contacting said first side leg and then extends toward the intersection of said second side leg and said bridge leg.

2. An improved paper clip of claim 1 wherein the gripping force at the torsional spring powered gripping points is large compared to the incremental force increase due to the insertion of a sheet of paper between the gripping legs.

3. An improved paper clip formed from a single length of wire divided into five legs by four bends and comprising:

a) A central bridge leg connected at its ends to a first and a second diagonally crossing side leg, said side legs making a first tangential contact at a point substantially below their midpoints, b) a first and a second ending leg extending upwards toward said central bridge leg respectively from the ends of said first and second side legs, said ending legs define V-shaped terminating before reaching the line of said central bridge leg, each pair of said side leg and attached said ending leg lying substantially in a plane adjacent to the plane of the other pair of said legs, and c) said first ending leg makes a second tangential contact with said second side leg, and d) elevated and controlled levels of torsional strain in said bridge leg and said first side leg serve as torsional springs to exert elevated and controlled minimum gripping forces at said first and second tangential contact points;

e) said minimum gripping forces at said first and second tangential contact points are large compared to the incremental force due to the insertion of single sheet of paper; and f) wherein either of the torsional spring powered said first and second tangential contact points can have their contacting legs separated while the other remains in contact.

4. An improved paper clip of claim 3 wherein said first ending leg make contact with said second side leg at a point separated from said first tangential contact point by a distance equal to, or greater than, approximately ⅓ the distance along said second side leg from said first tangential contact point to said bridge leg.

5. An improved paper clip of claim 4 wherein said first ending leg makes a bend after contacting said first side leg and then extends toward the intersection of said second side leg and said bridge leg.

6. An improved paper clip of claim 3 wherein said second ending leg crosses said first side leg and terminates with its cut end in the general vicinity of the bend joining said second side leg and said bridge leg.

7. An improved paper clip of claim 3 wherein said second ending leg crosses and makes tangential contact with said first side leg at a point separated from said first powered gripping point by a distance equal to, or greater than, approximately ⅓ the distance along said first leg from said first tangential contact point to said bridge leg.

8. An improved paper clip of claim 3 wherein said second ending leg makes tangential contact with said first side leg at a point along said side leg equal to, or greater than, approximately ⅓ the distance along said first side leg from said first tangential point to said bridge leg, and then bends and extends toward the intersection of said first side leg and said bridge leg.

9. An improved paper clip of claim 7 wherein elevated torsional strain in said second side leg serves as a third torsional spring to exert a gripping force at the tangential contact point between said second ending leg and said first side leg that is large compared to the incremental force due to the insertion of a sheet of paper between the gripping legs.

10. An improved paper clip of claim 8 wherein elevated torsional strain in said second side leg provides for a third torsional spring to exert a gripping force at the tangential contact point between said second ending leg and said first side leg that is large compared to the incremental force due to the insertion of a sheet of paper between the gripping legs.

* * * * *